United States Patent [19]

Schleffendorf

[11] Patent Number: 4,515,363

[45] Date of Patent: May 7, 1985

[54] WEIGHT LIFTING EXERCISER

[76] Inventor: John J. Schleffendorf, 2312 Crescent Ave., Waukegan, Ill. 60084

[21] Appl. No.: 356,635

[22] Filed: Mar. 10, 1982

[51] Int. Cl.[3] ..... A63B 21/06

[52] U.S. Cl. ..... 272/118; 272/134; 272/146; 272/DIG. 4

[58] Field of Search ..... 272/118, 117, 134, 143, 272/DIG. 4, DIG. 5, 93, 96, 146; 128/25 B, 25 R

[56] References Cited

U.S. PATENT DOCUMENTS

| | | | |
|---|---|---|---|
| 745,154 | 11/1903 | Chlada | 272/96 |
| 2,542,074 | 2/1951 | Bierman | 272/117 X |
| 3,774,597 | 11/1973 | Root | 128/25 B |
| 3,784,193 | 1/1974 | Simjiam | 272/146 X |
| 3,858,873 | 1/1975 | Jones | 272/117 |
| 3,911,907 | 10/1975 | Smith | 272/146 X |
| 4,200,282 | 5/1980 | Agyagos | 128/25 B X |
| 4,296,924 | 10/1981 | Anzaldua et al. | 272/117 |

FOREIGN PATENT DOCUMENTS

| | | | |
|---|---|---|---|
| Ad.3584 | of 1906 | United Kingdom | 272/96 |

OTHER PUBLICATIONS

Paramount Health Equipment Corp., Catalog p. 10, "Abdominal Twister", published before Aug. 10, 1981 (date unknown).

*Primary Examiner*—Richard J. Apley
*Assistant Examiner*—William R. Browne
*Attorney, Agent, or Firm*—Hill, Van Santen, Steadman & Simpson

[57] ABSTRACT

An exercising machine for especially training the muscles of the leg includes a base on which a pair of support tables is rotatably carried, one for each foot, a vertical standard on the base adapted to provide fixed hand grips for a standing user or a seat for a sitting user, and a pair of resistance devices preferably formed by a selectable number of weights. Each resistance device is respectively connected by a cable and pulley system to one of the support tables to provide a variable reactive force as the associated support table is moved out of a neutral position. The seat and hand grips can be set at a selected height, the hand grips can be set at three positions in one horizontal plane, and the foot-supporting portion of each support table can be placed in a selected angular position by which the neutral or starting position is picked. The machine can be used close to a wall.

16 Claims, 11 Drawing Figures

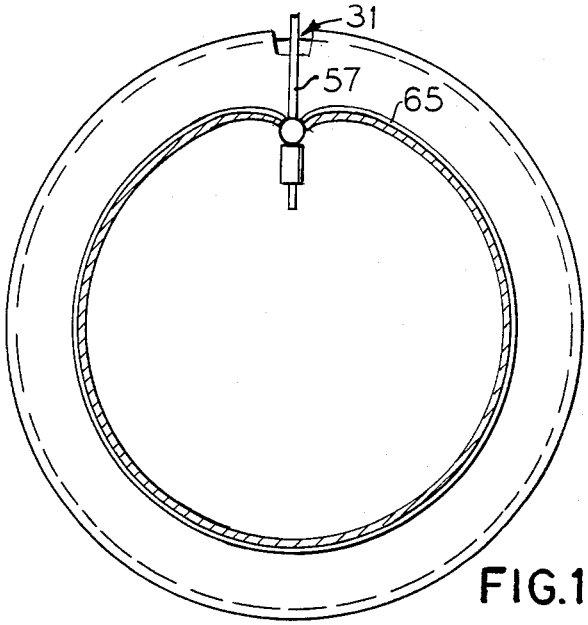
FIG.11
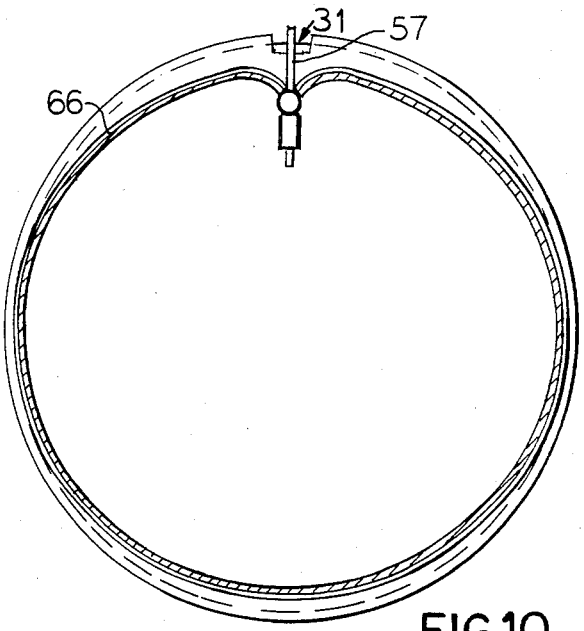
FIG.10
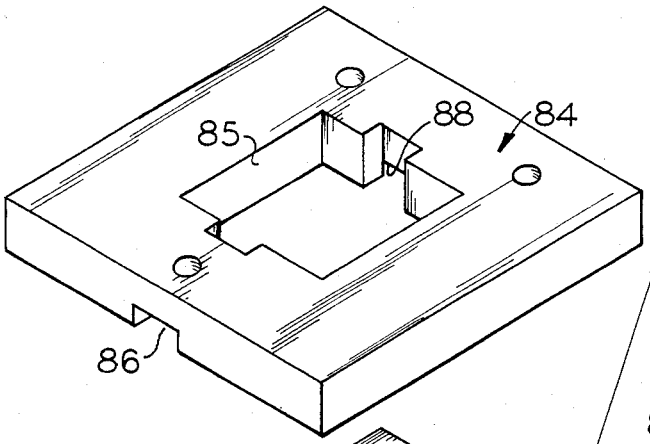
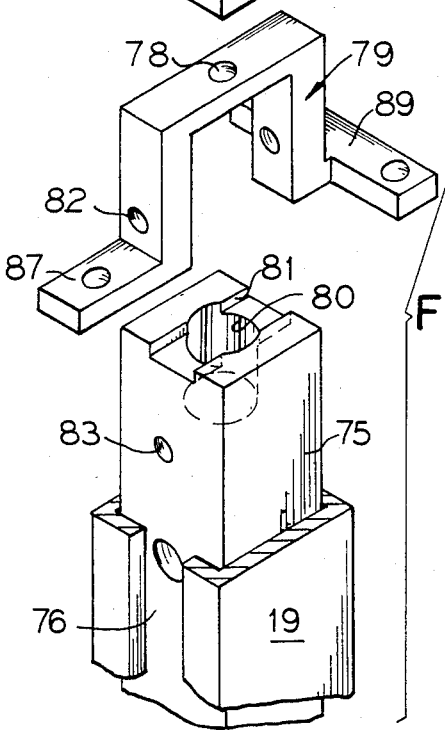
FIG.9
FIG.8
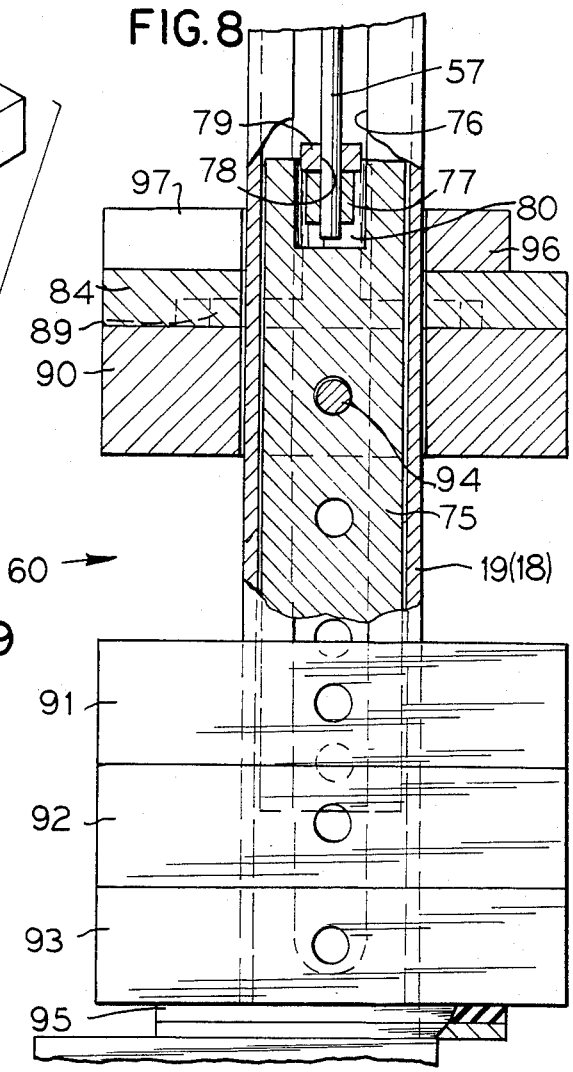

WEIGHT LIFTING EXERCISER

BACKGROUND OF THE INVENTION

1. Field of the Invention

This invention relates to physical exercise apparatus for use in developing human muscles.

2. Prior Art

The human body has a substantial number of muscle groups and in the past various types of mechanical exercise equipment have been used to increase both muscular strength and size. However, prior exercise devices have either been relatively complex or limited in versatility and efficiency in terms of the number of muscle groups an individual apparatus could adequately develop.

Physiological studies have shown that in most cases power output or strength exerted by the human limbs or trunk actually varies in intensity throughout the normal range of motion of these body parts, due to the unique interaction of muscular strength curves and skeletal leverage, and that maximal contraction of muscle fiber occurs when a muscle is sustained in a static or isometric contractile state.

Therefore, throughout the range of an exercise movement, resistance should, in most cases, match the power output of the contracting muscle or muscles, and ideally a static or isometric contraction should be experienced within the terminal range of the movement.

Designers of prior exercise equipment have failed to recognize this principle and have provided resistance curves, inadequate in terms of generating maximum contraction of muscle fiber at the position of greatest musculoskeletal strength advantage.

SUMMARY OF THE INVENTION

A physical exercising machine according to the invention includes a pair of rotatably supported tables, each adapted to support a single human foot, the tables being coupled with a pair of resistance devices, providing a reactive rotary force of automatically varying intensity in response to support table rotation, there being stationary transmitting means by which a reactive force is transmitted to the human body. The transmitting means are adjustable in order to adapt the exercising machine to a given size of person and to a given type of exercise, one such means being in the form of hand grips and another being in the form of a seat. The resistance means is in the form of weights acting through a cable on said support tables.

Several different exercises are designed for use with the apparatus and each exercise develops one or more of eleven identified muscle groups.

Accordingly, it is an object of the present invention to provide a rather versatile physical exercise apparatus.

Another object of the present invention is to provide an exercising machine which avoids the problems of the prior art.

Yet another object is to provide a machine which may be operated close to a building wall.

A still further object of the present invention is to provide various types of adjustments or settings which can be readily effected.

Many other advantages, features and additional objects of the present invention will become manifest to those versed in the art upon making reference to the detailed description and the accompanying sheets of drawings in which preferred structural embodiment incorporating the principles of the present invention is shown by way of illustrative example.

BRIEF DESCRIPTION OF THE DRAWINGS

FIG. 8 is an enlarged cross-sectional view taken along the line VIII—VIII of FIG. 2;

FIG. 9 is a perspective view of certain parts of FIG. 8, shown in exploded fashion; and FIGS. 10 and 11 are horizontal cross-sectional views of components that may be substituted for that shown in FIG. 7.

AS SHOWN IN THE DRAWINGS

Figure 1:
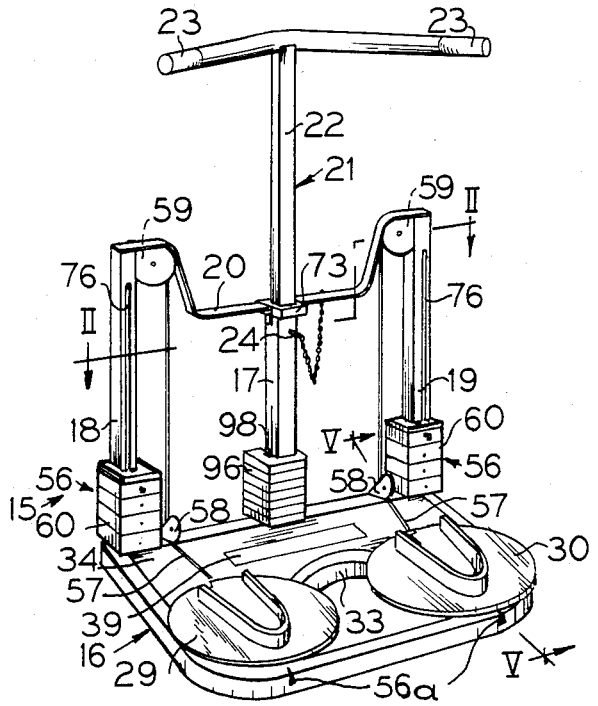
FIG. 1 is a perspective view of a physical exercising machine provided in accordance with the present invention.

A physical exercising machine according to the invention is shown in FIG. 1, generally indicated by the numeral 15. The machine 15 includes a base 16 to which is secured a vertical standard 17, and a pair of hollow vertical columns 18, 19, the upper ends of the standard 17 and columns 18, 19 being joined together by a primarily horizontal strap 20. The vertical standard 17 supports a transmitting means 21, here comprising a post 22 and a pair of hand grips 23. A manually removable or insertible pin 24 fixes the height of the post 22 at a selected height, there being a suitable number of holes in the post 22 which are capable of receiving the pin 24 in the manner illustrated in FIG. 2. The post 22 has additional holes 25, that extend through the post so that the post can be placed a quarter of a turn from the position shown in FIG. 1 and there locked in order to adjust the starting position of the hands for a given exercise. Thus, the holes lie substantially in one horizontal plane, and multiple sets of such holes enable the setting of the height of the hand grips to compensate for different heights of users.

Figure 4:
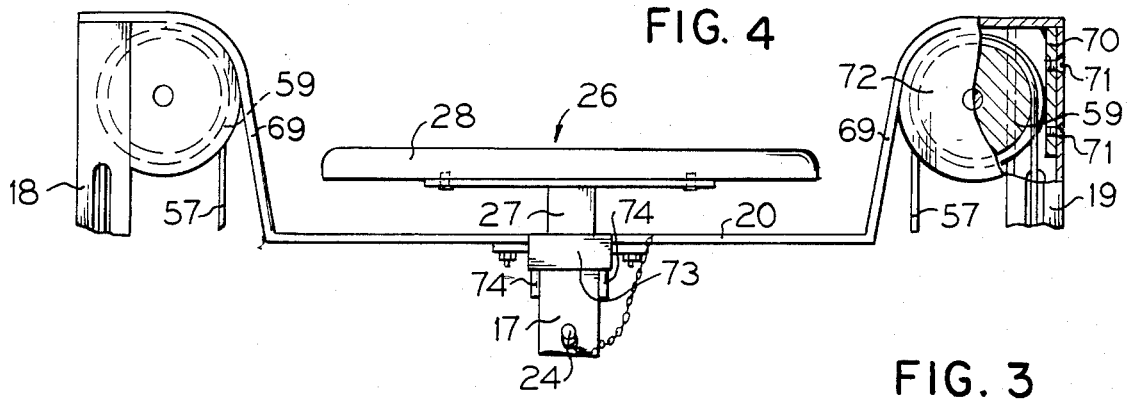
FIG. 4 is a fragmentary view of the upper portion of FIG. 3 with a seat substituted for hand grips as the transmitting means.

A further transmitting means 26 is shown in FIG. 4, it being in the form of a post 27 to which is secured a seat 28. The post 27 has a series of vertically spaced holes to receive the pin 24 to adapt the machine for other types of exercises for users of various height. Thus the transmitting means 21, 26 are manually releasable, are adjustable in height, and can be selected as to type, and in the instance of the transmitting means 21, the angular orientation can also be selected.

Figure 2:
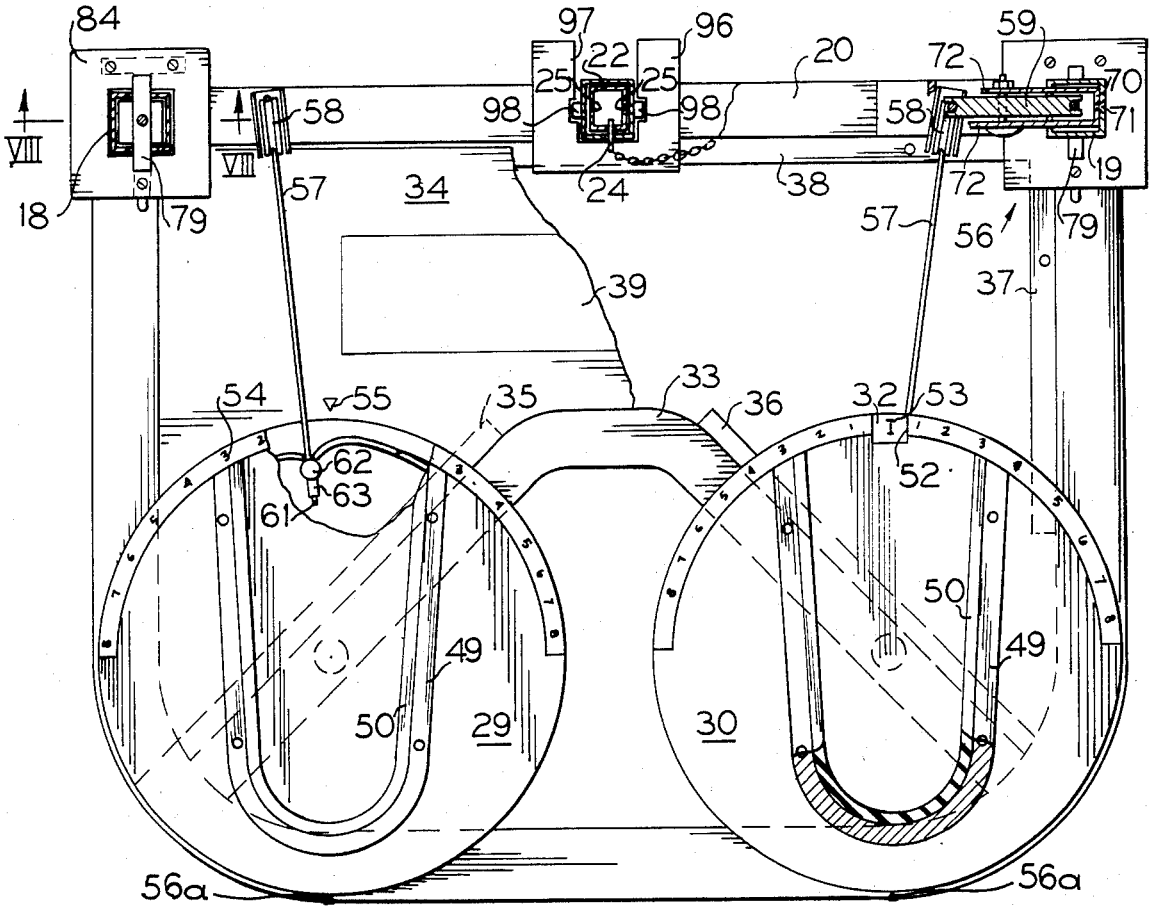
FIG. 2 is an enlarged cross-sectional view taken along the line II—II of FIG. 1.
Figure 3:
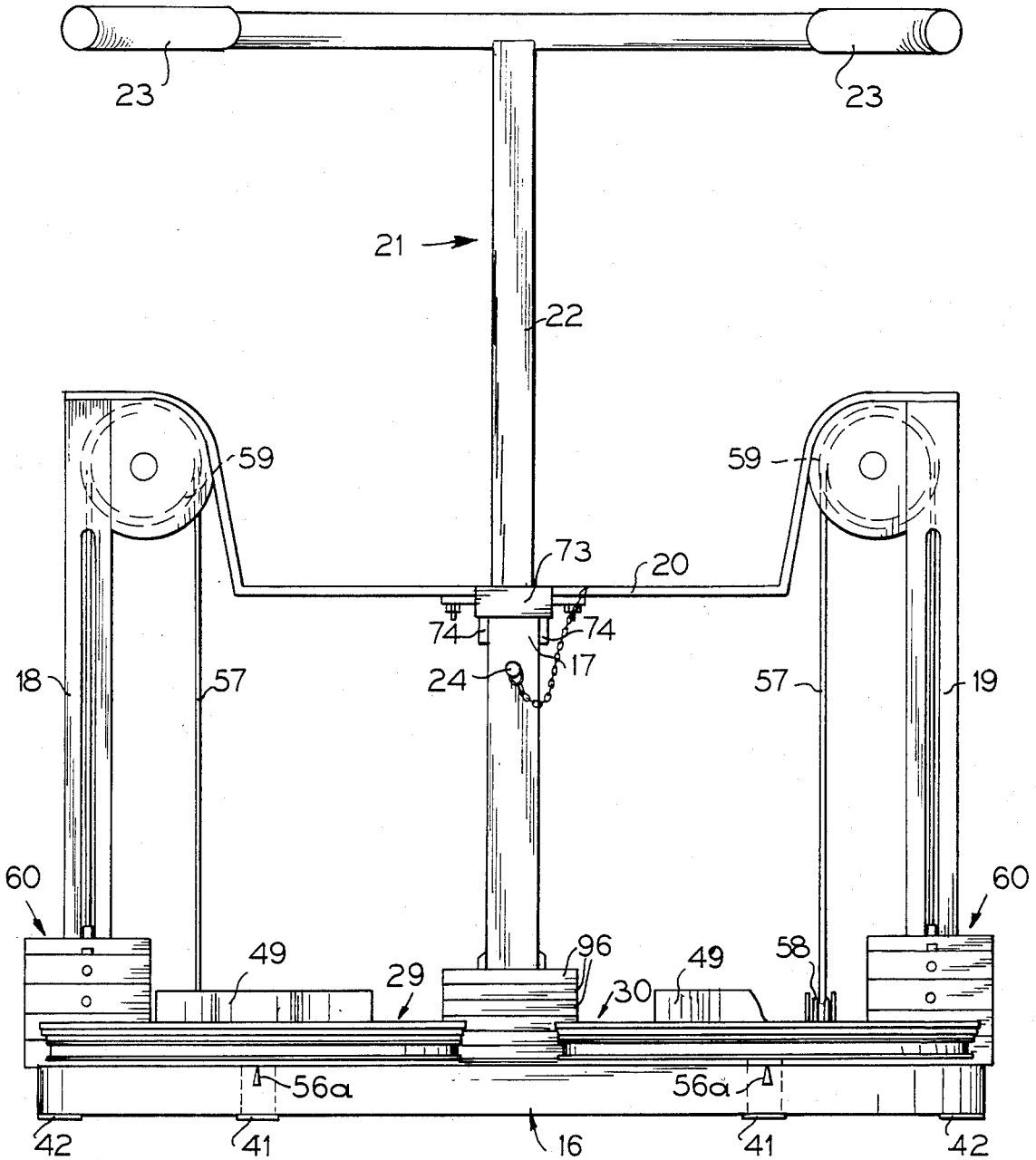
FIG. 3 is an enlarged front view of FIG. 1.
Figure 6:
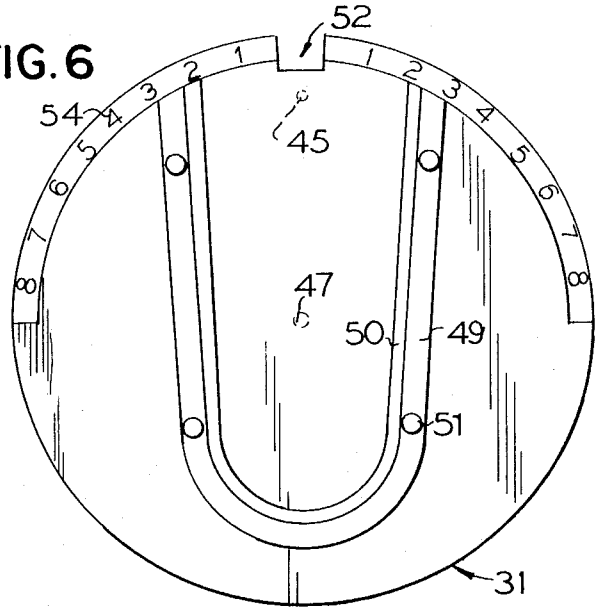
FIGS. 6 and 7 are top views of parts shown partially separated in FIG. 5.
Figure 5:
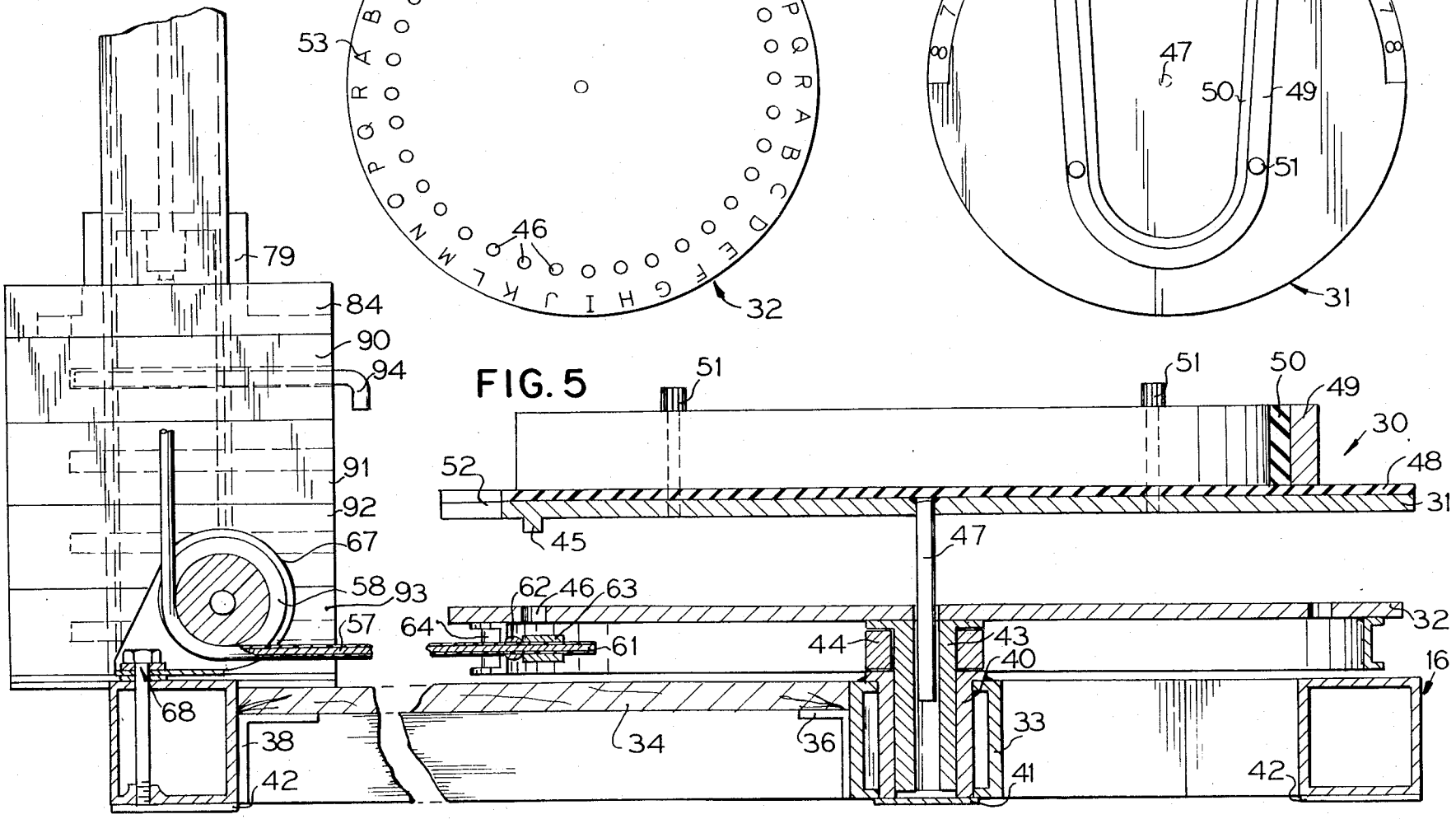
FIG. 5 is an enlarged cross-sectional view, with parts broken away, taken along the line V—V of FIG. 1.

The exercising machine 15 further includes a pair of rotatably carried support tables 29, 30 shown in each of FIGS. 1–3, the support table 30 being shown in partially exploded position in FIG. 5. Each of the support tables 29, 30, as best seen in FIG. 5, includes an upper part 31 and a lower part 32, there being radial and axial thrust bearings for each support table which coact with complemental bearing surfaces on the base 16, both described below.

The base 16 comprises hollow tubing of square cross-section which extends along the rear of the machine, along both sides, and across the front. The base 16 further includes another tubular portion 33 which extends toward the center from the front corners to form an obtuse angle. The space between the base portion 33 and the rear of the machine is covered by a panel 34, such as of wood, which is secured to and rests upon strips of angle iron 35, 36, 37, 38. The panel 34 supports an instruction plate 39 shown in FIGS. 1 and 2.

Figure 7:
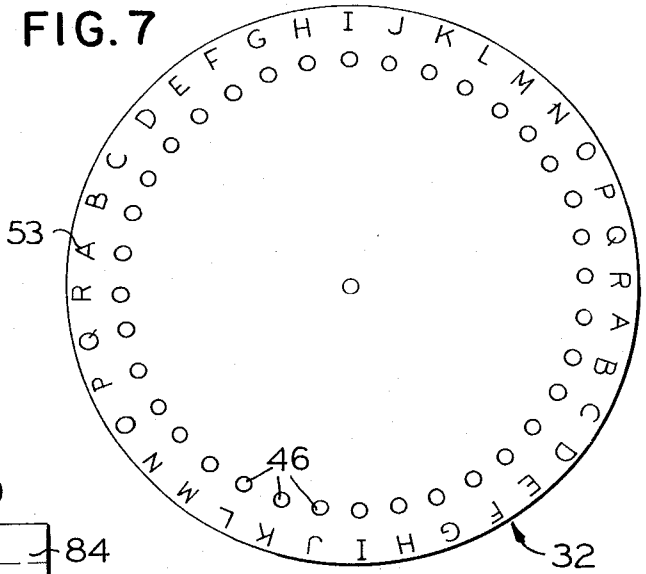

As best seen in FIG. 5, the base portion 33 is apertured and receives and supports a bearing insert 40, an inner cylindrical surface of which is normally lubricated with oil, there being a cap 41 secured to the lower end of the bearing insert 40 to retain it in place and to prevent any leakage of oil. The presence of the end cap or oil seal or retainer 41 also necessitates the use of a number of pads 42 at the corners of the base 16. The lower table part 32 has a hollow cylindrical bearing 43 secured thereto which is received in and guided by the bearing insert 40. An annular bearing 44 surrounds the upper end of the tubular bearing 43 and provides thrust reaction or support between flanges on the bearing insert and on the tubular bearing. The upper table part 31 has a guide pin 47 secured thereto which functions as a pilot and enables the upper table part 31 to be rotated with respect to the lower table part 32 when it is lifted as shown in FIG. 5 so that a locating pin 45 is retracted from one of a series of holes 46. With this arrangement, the upper table part can be raised slightly, rotated to a selected new position, and the locating pin be reengaged with a different one of the holes 46, there being a continuous series of such holes as shown in FIG. 7. An identifying indicia is placed on the upper surface of the lower part 32 adjacent to each hole 46, diametrically opposite holes 46 having the same indicia. The upper table part 31 is covered with a non-skid material 48, and in addition, has a U-shaped foot guide 49 secured thereto, the same being lined by a strip of cushioning material 50. The U-shaped foot guide is specifically shaped to accept primarily soft rubber soled sports or exercise shoes of the widest wariety of lengths and widths, and is shaped so that only a slight lateral rotary motion of the foot, at the beginning of an exercise movement, will cause the foot to lock against either inside face of the U-shaped foot guide. The U-shaped guides 49 are a preferred feature by which each support table is adapted to support a single human foot, a circumstance that applies to the exercises described below. Should a user wish to use the machine in a less preferred mode, the U-shaped guide can be readily detached as a set of mounting screws 51 can be manually removed. The upper table 31 has a viewing window or slot 52 through which one of the indicia 53 on the lower table part may be viewed, it being the one associated with the hole in which the location pin 45 is disposed. The upper part 31 also has a set of indicia 54, similar identification being provided at similar distances at either side of the viewing slot or window 52. The indicia 54 cooperate with suitable indicia such as 55 (FIG. 2) for indicating to the user how far a particular support table has been moved from a neutral or starting position, either clockwise or counterclockwise. In each of the views, the U-shaped guides 49 are directed to open toward the vertical standard 17 for use with the transmitting means 21. When the transmitting means 26 are employed, then the upper parts 31 of the support tables are raised and turned 180° from as shown in FIG. 5 so that the U-shaped guides are directed away from or open away from the vertical standard 17. Thus in any event, the transmitting means is always at a common lateral side to the support tables 29, 30. Thus the starting or neutral point for the U-shaped guides is adjustable for 360° in relatively small increments, namely 10° increments in this illustrated embodiment.

Just as the indicia 54 registered with the indicia 55 as shown in FIG. 2, when the U-shaped guides have been reversed, then the indicia 54 register with one of a pair of indicia **56*a*, 56*a*, on the base 16, best shown in FIG. 1**.

When the support tables 29, 30 are moved out of the starting or neutral position, such movement is opposed by resistance means generally indicated at 56. There is a resistance means for each of the tables, and one is either identical to the other or is the mirror image thereof. Thus, for convenience of illustration, portions of one or the other resistance means may be described or illustrated.

As best broadly shown in FIG. 1, each resistance means 56 includes a cable 57 which extends horizontally from the support table 29, 30, and then is directed upwardly about a first pulley 58 to the upper ends of the vertical columns 18, 19, and thence about a second pulley 59 which directs the cable downwardly within the hollow vertical column 18, 19, where the other end is secured to a system of weights 60. As best shown in FIGS. 2 and 5, one end 61 of the cable 57 extends through an aperture in the periphery of the lower table part and a pivotal connection is provided on said one end 61. Such connection includes a ball 62 and a sleeve 63 which is crimped or otherwise secured to the end 61 of the cable 57. The aperture in the periphery of the lower table part 32 is somewhat larger than the cable but is smaller than the diameter of the ball 62 so that when the cable is directed horizontally from a neutral position to either side, the ball rocks on the margin that defines the aperture, thereby eliminating any stress concentration at the pivotal connection. As best shown in FIG. 5, the lower table part 32 has an outer periphery in the form of a channel 64 which progressively receives the cable as the table is rotated from neutral. In the position shown in FIG. 2, the length of cable between the ball 62 and the first pulley 58 is at a minimum. As the table is rotated, this length progressively increases, thus providing a progressively longer moment arm so that the resistance to rotation caused by a given mass of weights progressively increases. The distance from the channel 64 to the periphery of the lower table part 32 is essentially a constant, at least for a major portion of its extent. in FIGS. 2 and 5, the channel 64 is illustrated as lying near the full radius of the table part 32. If desired, a smaller constant radius of the table part 32. If desired, a smaller constant radius may be utilized to alter the effectiveness of a given mass of weights, and thus enable one to decrease the necessary overall height of the vertical columns 18, 19, by reducing the length of upward travel of the elongated plugs 75. A smaller radius channel 65 is illustrated in FIG. 11. Another way of altering the amount of resistance as a function of table movement is illustrated in FIG. 10, wherein unlike FIG. 11, which has a constant radius for a major portion, a channel 66 has a radius that gradually increases remotely from the neutral position, the representing any shape deemed necessary to provide the desired variable resistance curve.

As shown in FIG. 5, the first pulley 58 is supported in a mounting bracket 67 which has a pivotal connection 68, with the base 16 whereby the pulley 58 is self-aligning with the cable 57 as the table is rotated from the neutral position, or returned to the neutral position.

FIGS. 2 and 4 best illustrate the structure by which the second pulley 59 is supported. While the strap 20 is primarily horizontal, each end portion 69 thereof is directed upwardly, and thence about the pulley 59 and thence horizontally to the outer surface of the vertical column 18, 19. A mounting plate 70 is secured near the outer end of the strap 20 and the mounting plate 70 extends straight down and is disposed inside the hollow vertical column 18, 19. A pair of screws 71 holes these components in the illustrated position. The outermost end of the strap 20 slightly overlaps the vertical column 18, 19 as shown in FIG. 4 so that no shear forces are applied to the screws 71. This arrangement requires that the inner side of each column 18, 19 be cut away to enable the pulley to extend inwardly to a point where the cable 27 will be directed centrally down through the respective columns 18, 19. The pulley 59 is pivotally carried on a pair of bearing and guard plates 72, disposed at opposite sides of the pulley 59, the plates 72 being secured at their periphery to the portion 69 of the stap 20 and also to the mounting plate 70.

The strap 20 is also supported centrally by the upper end of the vertical standard 17. The central portion of the strap 20 has an enlargement 73 which receives the upper end of the vertical standard 17. A pair of right angle brackets 74, 74 is secured to opposite sides of the vertical standard 17, and the strap 20 rests on and is bolted to the upper surface of the brackets 74, 74, enlargement 73 being slotted at opposite sides to receive the corners of the brackets 74, 74 snugly, thereby rigidifying the connection with the vertical standard 17.

The weights or weight system 60 is so constructed that the center of gravity thereof coincides with the end of the cable secured thereto. The weights or weight system 60 are disposed partially within the hollow vertical columns 18, 19, partially on the outside thereof, and auxiliary weights are stored on the outside of the vertical standard 17. FIGS. 8 and 9 illustrate this relationship. Within each hollow column 18, 19, there is an elongated plug 75 which is one of the weights. FIG. 8 illustrates the position of that weight or plug 75 when the table is not at the neutral position. The vertical columns 18, 19 are slotted at opposite sides with slot means 76 that open through the walls of the vertical columns toward the rear of the machine and toward the front of the machine. It is believed that the construction can be best understood by a description of how it is put together. The end of the cable 57 is fitted into a ferrule 77 and fixedly secured thereto. Either before or after this step, the cable is also threaded through an uppermost aperture 78 in a connector or yoke 79, the yoke 79 being shown in FIG. 9. The end of the yoke 79 nearer the viewer in FIG. 9 is then passed through the slot means 76, 76 above the elongated plug 75 and lowered so that the ferrule 77 fits into a cavity 80 in the plug 75, and the upper horizontal portion of the yoke 79 fits into a slot 81. At this point, an aperture 82 at each side is in registration with a threaded aperture 83 in the plug 75 and a pair of mounting screws (not shown) are inserted. Thus, the vertical portions of the yoke 79 project outwardly through the slot means 76. At this point, a flat weight 84 is fitted over the outside of the vertical column 19 and lowered onto the yoke 79. A central opening 85 has clearance with respect to the column 19 and the opening 85 is notched at its front and rear edges so that the vertical portions of the yoke 79 can pass therethrough. The lower side of the weight 84 has a groove 86 that extends forwardly and which receives a forward portion 87 of the yoke 79 and the rear portion of the weight 84 at its lower side has a transverse groove 88 which receives a transverse lower portion 89 on the yoke 79. When these parts are so interfitted, then apertures in the lower portions 87, 89 are in registration with corresponding apertures of the weight 84 to receive fastening means. Thus the weight plug 75 within the column 19 is rigidly connected to the external weight 84 for joint movement. The assembly of the movable parts of FIG. 9 thus constitutes the minimum weight mass and hence the source of the minimum resistance that the resistance means can provide.

There are two means by which this minimum mass can be increased. As shown in FIG. 8, the plug 75 extends for a distance below the lower surface of the weight 84 and is provided a series of apertures which register with the vertical slot means 76. In surrounding relation to the vertical column 19, there is disposed a further set of weights 90–93, each of which has a transverse aperture which registers with the slot means 76. When the table is in the neutral position, all the weights 84, 90–93 will be in the lowermost position, and the apertures in the weights are in registration with the apertures in the plug 75. A connector pin 94 may be selectively inserted through the vertical slot means 76 and any one of the sets of aligned apertures. Since these are all located below the weight 84, depending upon which aperture is selected, from one to all of the additional weights may be coupled to the weight 84. Then when the table is rotated from the neutral position, the weights 75, 84 and 90 move up, the connector pin 94 having been inserted in the uppermost weight 90, as illustrated in FIG. 8. A cushion 95 is provided below the lowermost weight 93. The weights 90–93 are made symmetrical and have clearance with respect to the column 19. While the weight plug 75 also has a clearance, if desired, the respective clearances can be so made that only the plug 75 of the pendulous mass could possibly engage the column 19, and if desired, means may be provided for minimizing sliding friction, thereby providing an accurate selection of weight mass.

A second form of supplemental weight means 96 is shown in FIG. 1 nested on the vertical standard 17. The weights 96 are U-shaped so that when manually picked up, it can be forwardly withdrawn from the standard 17. One such weight 96 is shown in place in FIG. 8 above the weight or plate 84. Each of the weights 96 has the same extent (FIG. 2) to the left, to the right, and to the rear, as the weight 84. However, a slot 97 enables it to receive the standard 17 and the column 18, 19. To compensate for the loss of mass that such slot provides, a suitable amount of mass is removed from the opposite side so that the center of gravity is still at the center of its aperture. The central aperture of each weight 96 has the same configuration as the aperture 85 of the weight plate 84. As stated previously, the upper end of the yoke 79, also referred to herein as a connector, projects horizontally through the slot means 76 as shown in FIG. 2. Thus the profile of the column 18 taken with the connector 79 corresponds to the profile of the aperture 85 shown in FIG. 9. This then is also the profile of the aperture in the auxillary weights 96, thus they also receive in opposite slots the projecting portions of the connector or yoke 79. This arrangement provides precisioned relative location so that the registration of the center of gravity of the weight 96 is properly placed.

The slot 97 of the weight 96 is directed laterally when the weight 96 is in use, and is directed rearwardly when it is in storage. To maintain proper storage of the weights 96, a pair of connector simulators 98 is secured to the lateral surfaces of the vertical standard 17 to retain the weights that are not in use.

Proper selections and settings having been made by a knowledgeable user or prescribed by a physical therapist, the user in a standing position rotates one or both legs at the hip. If the toes point outward at the neutral position of the tables, then medial rotation of the leg against the force of the resistance means trains or develops the following muscle groups: adductor magnus, adductor brevis, and gluteus medius.

If the user starts with the toes pointed inwardly, then the rotation of the leg is lateral. Such exercise trains or develops the following muscle groups: gluteus maximus, piriformis, quadratus femoris, obturator internus, and obturator externus.

With the user in a seated position, exercises can be performed to rehabilitate knee injuries and also to prevent knee injuries by building up the muscles that support the back of the knee. Medial rotation of the leg develops the following muscle groups: semitendinosus, semimembranosus, and popliteus. Lateral rotation of the leg while seated develops the biceps femoris.

If a person is standing on only one disc, the grasping of the hand grips fixes the shoulder position and rotation of the torso or abdominal region exercises the external and internal obliques, among other muscle groups.

From the foregoing, it can be seen that a wide range of exercises can be performed with this single machine for the development of a wide range of muscles of the human body.

Although various minor modifications may be suggested by those versed in the art, it should be understood that I wish to embody within the scope of the patent warranted hereon, all such embodiments as reasonably and properly come within the scope of my contribution to the art.

I claim as my invention:

1. An exercising machine, comprising:

(a) a base;

(b) a pair of support tables rotatably carried on said base, and each adapted to support a single human foot, respectively;

(c) a vertical standard supported on said base and having means at its upper end for transmitting a reactive force to the human body, said transmitting means including a seat at its upper end secured to a post telescopically and releasably engaging said vertical standard, said post being lockable thereto at a plurality of heights, and said standard being disposed at a common lateral side of said support tables; and (d) a pair of resistance means supported on said base and respectively independently connected to said support tables for providing a reactive rotary force to support table rotation as each table is moved out of a neutral position.

2. An exercising machine, comprising:

(a) a base;

(b) a pair of support tables rotatably carried on said base, and each adapted to support a single human foot, respectively;

(c) a vertical standard supported on said base and having means at its upper end for transmitting a reactive force to the human body, said standard being disposed at a common lateral side of said support tables; and (d) a pair of resistance means supported on said base and respectively independently connected to said support tables for providing a reactive rotary force to support table rotation as each table is moved out of a neutral positon, said resistance means comprising (1) a cable secured at one end to one of said support tables and engageable with an outer periphery thereof as said support table is moved out of the neutral position, said cable extending therefrom horizontally, said one end of said cable extending through an aperture in said outer periphery, and also through a ball secured to said one end, said ball being larger than said aperture and providing a pivotal connection between said one end and said table, (2) a first pulley on said base directing said cable from the horizontal to a vertical direction;

(3) a second pulley disposed above on said base for reversing the vertical direction of the cable; and (4) weight means for resisting rotation of said support tables, said weight means being secured to the other end of said cable.

3. An exercising machine, comprising:

(a) a base, including a pair of hollow vertical columns forming a part thereof;

(b) a pair of support tables rotatably carried on said base, and each adapted to support a single human foot, respectively;

(c) a vertical standard supported on said base and having means at its upper end for transmitting a reactive force to each the human body, said standard being disposed at a common lateral side of said support tables;

(d) a pair of resistance means supported on said base and respectively independently connected to said support tables for providing a reactive rotary force to support table rotation as each table is moved out of a neutral position, each said resistance means comprising:

(e) a cable secured at one end to each said support table and engageable with an outer periphery thereof as said support table is moved out of the neutral position, said cable extending therefrom horizontally;

(f) a first pulley on said base directing said cable from the horizonal to a vertical direction;

(g) a second pulley disposed thereabove on said base reversing the vertical direction of each cable, each of said second pulleys being respectively supported at the upper ends of said pair of hollow vertical columns, and directing said cables downwardly therein; and (h) weight means secured to the other end of each said cable, said weight means including a pair of elongated plugs respectively disposed in said hollow columns and connected to said other ends of said cables, said weight means further including a number of individual weights embracing said hollow column; and (i) a connector joining one individual weight to one of said elongated plugs and extending through a vertical slot in said hollow column.

4. An exercising machine according to claim 3, each of said elongated plugs extending through other of said weights disposed below said one weight, and a connecting pin for being received in said slot means and in aligned apertures in said elongated plug and a selected one of said other weights.

5. An exercising machine according to claim 3, including a number of U-shaped weights selectively receivable on said one individual weight for augmenting the mass of said weight means.

6. An exercising machine according to claim 5, the lower end of said vertical standard being adapted to store those U-shaped weights which are not then in use.

7. An exercising machine, comprising:

(a) a base;

(b) a pair of support tables rotatably carried on said base, and each adapted to support a single human foot, respectively, at least one of said tables having a U-shaped guide receptive of the human foot, said one of said tables including upper and lower parts having substantially flat matting surfaces, said U-shaped guide being secured to said upper part, the angular position of said upper part being selectable with respect to said lower part;

(c) a vertical standard supported on said base and having means at its upper end for transmitting a reactive force to the human body, said standard being disposed at a common lateral side of said support tables; and (d) a pair of resistance means includes a pair of support cables, said pair of resistance means being supported on said base and respectively independently connected to said pair of support cables for providing a reactive rotary force to support table rotation as each table is moved out of a neutral position, said resistance means being secured to said lower part, whereby the position of the foot at the neutral table position may be selected.

8. An exercising machine according to claim 7, including both radial and axial thrust bearings on said lower part coacting with complemental bearing surfaces on said base.

9. An exercising machine according to claim 8, one of said table parts having a series of arcuately arranged apertures, the other of said table parts having a locator pin receivable in a selected one of said table apertures, and said upper table part having a central pilot pin receivable in said bearings on said lower part.

10. An exercising machine according to claim 7, said table parts having indicia thereon to identify a selected neutral position in said U-shaped guide, and said upper table part and said base having indicia thereon to identify the position to which said table has been moved against the force of said resistance means.

11. An exercising machine, comprising:

(a) a base;

(b) a pair of support-tables rotatably carried on said base for movement about its vertical rotational axis in either angular direction from a neutral position, and each adapted to support a single human foot, respectively;

(c) a single vertical standard non-rotatably supported on said base, said standard having operationally fixed means at its upper end for engagement with a portion of the human body for transmitting a reactive force to the human body portion to keep such human body portion substantially stationary, and said standard at its lower end being spaced on said base uniformally radially from said vertical rotational axis of said tables by an amount corresponding substantially to the length of a user's thigh; and (d) a pair of resistance means supported on said base in spaced apart relation to each other by an amount receptive of the width of a human body, and respectively independently connected to said pair of support tables for providing separate reactive rotary forces to support-table rotation and hence to the feet as each table is moved out of the neutral position by leg muscles.

12. An exercising machine according to claim 11, said transmitting means being manually releasable to enable at least selection of the height thereof, and to enable the removal and hence a subsequent interchange of use of a seat and a hand grip in said standard.

13. An exercising machine according to claim 11, said operationally fixed transmitting means including a single post having a pair of spaced hand grips at its upper end secured thereto, said post telescopically and releasably engaging said vertical standard, said post being releasably lockable against angular movement in at least two different angular spaced positions of said hand grips at a given height thereof.

14. An exercising machine according to claim 11, each said resistance means of said pair comprising:

(a) a cable secured at one end to said support table and engaging with an outer periphery thereof as said support table is moved out of the neutral position, said cable extending therefrom horizontally;

(b) a first pulley on said base directing a portion of said cable leading from said table from the horizontal to an upward vertical direction;

(c) a second pulley disposed on said base above said first pulley and reversing a further portion of said cable to a downward vertical direction of the cable; and (d) weight means including a single stack of weights secured to the other end of said cable, and biasing said table toward the neutral position; and (e) said second pulley having a diameter which spaces said upward and downward portions of said cable to provide continuous clearance for said weight means.

15. An exercising machine according to claim 14 including:

(a) a pair of hollow vertical columns forming part of said base;

(b) a portion of each of said weight means surrounding said columns respectively and at all times disposed in radially spaced relation thereto; and (c) a primarily horizontal strap forming part of said base and connecting the upper ends of said columns to the upper part of said vertical standard.

16. An exercising machine according to claim 15, including a pair of housings secured to said columns and supporting and enclosing said second pulleys, the ends of said strap forming a part of said housings.

* * * * *